US005538465A

United States Patent [19]

Netsu et al.

[11] Patent Number: 5,538,465

[45] Date of Patent: Jul. 23, 1996

[54] ELASTIC FOAMED SHEET AND WAFER-POLISHING JIG USING THE SHEET

[75] Inventors: Shigeyoshi Netsu, Darul Ehsan, Malaysia; Kihachiro Watanabe, Fukushima-ken; Makoto Tsukada, Saitama-ken, both of Japan

[73] Assignee: Shin-Etsu Handotai Co., Ltd., Tokyo, Japan

[21] Appl. No.: 369,653

[22] Filed: Jan. 6, 1995

Related U.S. Application Data

[62] Division of Ser. No. 35,608, Mar. 23, 1993, Pat. No. 5,409,770.

[30] Foreign Application Priority Data

Jul. 7, 1992 [JP] Japan ..... 4-203039

[51] Int. Cl.[6] ..... B24B 7/04

[52] U.S. Cl. ..... 451/397; 451/289; 451/398

[58] Field of Search ..... 451/397, 398, 451/402, 281, 289, 385, 287, 288

[56] References Cited

U.S. PATENT DOCUMENTS

| | | | |
|---|---|---|---|
| 3,284,274 | 11/1966 | Hulslander | 161/159 |
| 4,841,680 | 6/1989 | Hoffstein | 51/283 R |
| 5,101,602 | 4/1992 | Hashimoto | 51/216 L |

FOREIGN PATENT DOCUMENTS

| | | |
|---|---|---|
| 0454362 | 10/1991 | European Pat. Off. . |
| 61-014854 | 6/1986 | Japan . |

*Primary Examiner*—Jenna L. Davis
*Attorney, Agent, or Firm*—Ronald R. Snider

[57] ABSTRACT

An elastic foamed sheet is disclosed which is usable as waxless polishing backing pads for wafers and capable of producing mirror polish wafers excelling in flatness.

This elastic foamed sheet possesses at least a foamed layer 2 and is characterized by the fact that a plurality of bubbles 4 in the foamed layer 2 meet the following conditions:

(1) that the bubbles are slender discrete bubbles erected parallelly to one another and dispersed at a substantially equal pitch in the direction of width of the foamed layer 2 and the bubbles 4 are substantially equal in size, shape, and position of formation in the direction of thickness of the foamed layer 2, (2) that center lines of the bubbles 4 in the direction of length thereof are parallel to the direction of thickness of the foamed layer 2, and (3) that the diameters of the bubbles 4 are minimized in the terminal part of the foamed layer 2 on one surface side thereof and gradually increased in the direction from the one surface side to the other surface side of foamed layer 2 until the bubbles form openings 6 thereof in the surface of the foamed layer 2.

17 Claims, 5 Drawing Sheets

ELASTIC FOAMED SHEET AND WAFER-POLISHING JIG USING THE SHEET

This is a division of application Ser. No. 08/035,608 filed Mar. 23, 1993, which has been allowed now U.S. Pat. No. 5,409,770.

BACKGROUND OF THE INVENTION

1. Field of the Invention

This invention relates to an elastic foamed sheet which is particularly suitable for backing pads to be used for retaining a semiconductor wafer on a rotary attaching disc of a polishing device in the process of mirror polishing of the semiconductor wafer and a wafer-polishing jig using the elastic foamed sheet.

2. Description of the Prior Art

The semiconductor wafers to be used for IC's and LSI's require at least one of the opposite surfaces thereof to be given a mirror finish by polishing. Generally, this polishing is effected by keeping a given wafer securely on the rotary attaching disc of the polishing device and pressing this wafer against an abrasive cloth laid on a stationary disc similarly kept in rotation while supplying an abrasive liquid to the interface of abrasion.

As means to retain the wafers on the polishing carrier plates in this case, the wax method which attains fast retention of the wax on the carrier plates by applying wax to one surface of the wafer and fastening the wafer to the carrier plates through the medium of the wax. This method enjoys the advantage of enabling the wafer surface to be polished with high planar accuracy. Owing to the use of the wax for fastening the wafer to the polishing device, however, this method suffers from numerous disadvantages that the work of attaching or detaching the wafer to and from the polishing device consumes much time and labor, that the work of cleaning the polishing device after each use thereof calls for an enormous toil, that the remaining wax defiles the wafer being handled, and that the special solvent to be used in the process of cleaning goes to jeopardize the work environment.

As means to eliminate these problems, the waxless method has been developed which effects the fast retention of a wafer on the rotary attaching disc of the polishing device not through the medium of wax but through the medium of a laminate of sheets each obtained by impregnating an artificial leather sheet or a non-woven fabric of polyester fibers with a polyurethane resin and imparting a finely foamed structure to the surface of the impregnated sheet. At present, this method is in popular use.

The conventional laminate mentioned above is generally constructed as illustrated in FIG. 8. To be more specific, a retaining backing 51 constructed to have a wafer held fast against the lower surface thereof, a reinforcing member 52, a carrier 53, and a peel paper 54 are superposed sequentially in the order mentioned and adhesive agents 55, 56, and 57 are interposed between the adjoining layers so as to Join them fast. The peel paper 54 can be peeled from the layer of the adhesives 57 when the laminate is attached to the rotary attaching disc of the polishing device.

The waxless method which used the laminate described above has the advantage that the laminate permits the wafer to be attached thereto and detached therefrom so easily as to enhance the efficiency of quantity production of wafer. It has been pointed out, however, that wafers polished by the waxless method are inferior in planar accuracy to those produced by the wax method. When wafers are to be polished by the use of the conventional laminate described above, the highest attainable flatness of the polished surfaces expressed by TTV (total thickness variation) is on the order of 5 μm. This polishing cannot decrease this magnitude any further. This limited flatness may be ascribed to the use of the peel paper 54 in the conventional laminate and to the numerosity of the component layers of the laminate. The term "TTV" mentioned above refers to the difference between the highest point and the lowest point of thickness of a polished wafer expressed in μm.

The reason for the aforementioned inability to lower the magnitude of flatness below about 5 μm may be logically explained as follows.

Since the peel paper 54 itself contains fairly large undulations in the surface thereof and further since the peel paper 54 engulfs air while a tackiness agent Or adhesive agent 57 is applied to the surface of the carrier 53 and the peel paper 54 is superposed on the applied layer of the tackiness agent or adhesive agent and the peel paper 54 is then wound up, the layer of the tackiness agent or adhesive agent 57 fails to assume a uniform thickness. Thus, the surface of the retaining backing 51 does not become flat when the laminate is attached to the rotary attaching disc.

Further, owing to the fact that the conventional laminate has a large number of component layers (seven layers inclusive of the peel paper 54 in the illustrated example), the rises and falls or undulations formed on the surface of the retaining backing 51 are suffered to become large because the ununiformities of thickness in the component layers of the laminate are accumulated while they are superposed even if these component layer are produced each with the highest possible uniformity.

In the internal structure of the conventional laminate, the bubbles occluded therein have a random size distribution and the reinforcing fibers incorporated therein have a random density and direction arrangement. Owing to this internal structure, when the laminate is pressed and polished in conjunction with the wafer, the compression deformation of the laminate is locally deprived of uniformity on the rear surface of each of a plurality of wafers retained on the carrier plates or on the rear surface of one and the same wafer. As a result, the amount of polishing to be attained is locally deprived of uniformity. This local ununiformity may well be considered to form one of the factors responsible for the limited flatness mentioned above.

SUMMARY OF THE INVENTION

This invention has been produced for the purpose of solving the problems of the prior art described above. An object of this invention is to provide an elastic foamed sheet suitable for wafer-retaining backing pads and capable of enabling the wafers which have been polished as attached fast to a rotary attaching disc of a polishing device through the medium of the backing pad to acquire exceptionally high flatness and a wafer-polishing jig using the elastic foamed sheet.

BRIEF DESCRIPTION OF THE DRAWINGS

This invention will be better understood and the other objects and features of the invention will become apparent when consideration is given to the following detailed description thereof, which makes reference to the annexed drawing wherein.

FIG. *6a* and FIG. *6b* are schematic cross sections illustrating the state of retention of a wafer on a rotary attaching disc of a grinder.

Figure 7:
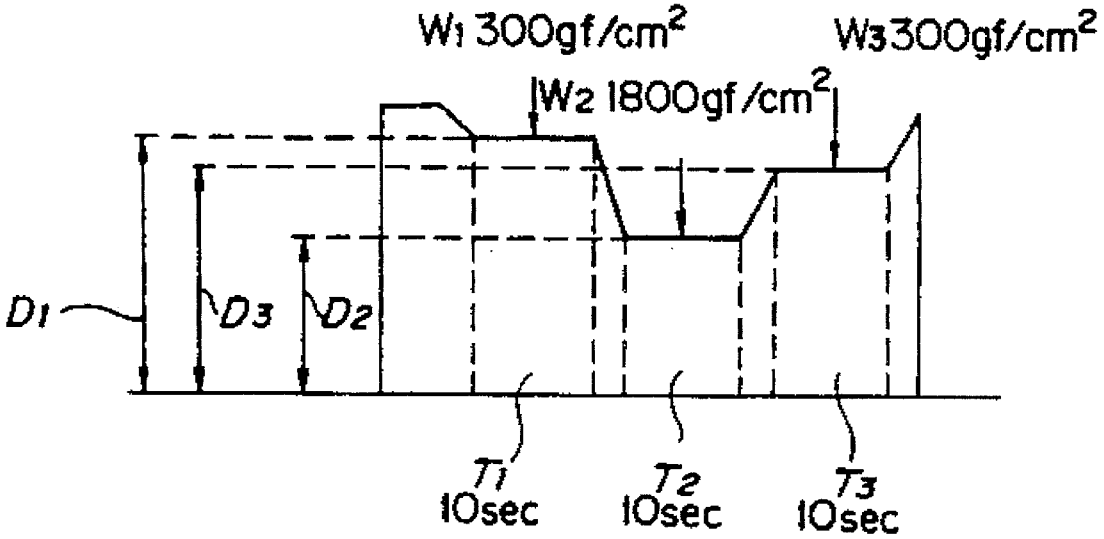

FIG. 7 is an explanatory diagram illustrating a procedure for the determination of mechanical properties of a foamed layer in an elastic foamed sheet.

Figure 8:
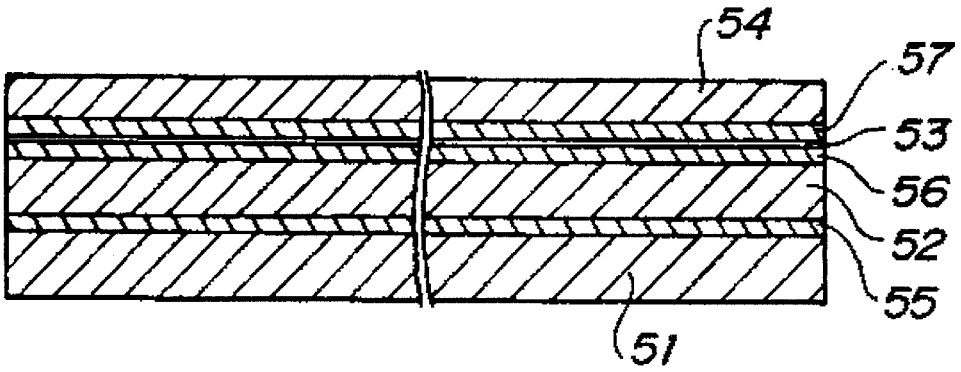
FIG. 8 PRIOR ART

FIG. 8 is a schematic cross section illustrating part of the conventional elastic foamed sheet.

DETAILED DESCRIPTION OF THE PREFERRED EMBODIMENTS

The first aspect of this invention consists in an elastic foamed sheet possessing at least a foamed layer, characterized by the fact that a plurality of bubbles in the foamed layer meet the following conditions:

(1) That the bubbles are slender discrete bubbles erected parallelly to one and dispersed at a substantially equal pitch in the direction of width of the foamed layer and the bubbles are substantially equal in size, shape, and position of formation in the direction of thickness of the foamed layer, (2) That the center lines of the bubbles in the direction of length thereof are parallel to the direction of thickness of the foamed layer, and (3) That the diameters of the bubbles are minimized in the terminal part of the foamed layer on one surface side thereof and gradually increased in the direction from the one surface side to the other surface side of the foamed layer until the bubbles form openings thereof in the surface of the foamed layer.

The second aspect of this invention consists in an elastic foamed sheet which comprises the aforementioned foamed layer of a large thickness and a substrate layer adjoining the foamed layer integrally, serving to support the foamed layer, and containing substantially no bubble.

The third aspect of this invention recited in the aforementioned second aspect consists in an elastic foamed sheet characterized by the fact that the foamed layer thereof meets the following conditions:

(1) That the diameters of the openings of bubbles are from 40 to 200 μm, (2) That the thickness of the foamed layer exceeds 20 μm, (3) That the surface void ratio of the foamed layer [total sum of the areas of the openings of bubbles divided by the area of the wafer-supporting surface of the foamed layer (inclusive of the areas of openings of bubbles) and multiplied by 100] is from 90 to 98%.

(4) That the softness of the foamed layer (difference $D_1-D_2$, wherein $D_1$ stands for the thickness of the foamed layer assumed under a load of 300 gf/cm$^2$ ×10 seconds and D, for the thickness of the foamed layer assumed under a load of 1,800 gf/cm$^2$×10 seconds respectively exerted on the wafer-retaining surface of the foamed layer) is from 50 to 100 μm.

(5) That the recovery ratio of the foamed layer defined by the following formula is from 50 to 80%:

$$\text{Recovery ratio}=(D_3-D_2)/(D_1-D_2)\times 100(\%)$$

(wherein $D_1$ and $D_2$ have the same meanings as defined above and $D_3$ stands for the thickness of the foamed layer assumed under a load of 300 gf/cm$^2$×10 seconds exerted on the wafer-supporting surface of the foamed layer subsequently to the sequential exertion of a load of 300 gf/cm$^2$×10 seconds and a load of 1.800 gf/cm$^2$×10 seconds in the order mentioned), and (6) That the compression ratio of the foamed layer defined by the following formula is from 30 to 50%:

$$\text{Compression ratio}=(D_1-D_2)/D_1\times 100(\%)$$

(wherein $D_1$ and $D_2$ have the same meanings as defined above).

The forth aspect of this invention consists in a wafer-polishing jig characterized by the fact that an elastic foamed sheet recited in the aforementioned first aspect of this invention is attached exclusively through the medium of an adhesive layer to the entire upper surfaces of carrier plates and a template furnished with holes for positioning wafers for mirror polishing and attached through the medium of an adhesive layer to the upper surface of the elastic foamed sheet.

The fifth aspect of this invention consists in a wafer-polishing jig characterized by the fact that a template furnished with holes for positioning wafers for mirror polishing is attached to the upper surfaces of carrier plates through the medium of an adhesive agent and discs of an elastic foamed sheet recited in the aforementioned first aspect of this invention in shapes slightly smaller than those of the holes are attached to the positions of the holes through the medium of an adhesive layer.

The elastic foamed sheet of this invention comes in two types, one type consisting exclusively of a foamed layer and the other type consisting of a foamed layer of a large thickness and a substrate layer adjoining the foamed layer integrally, serving to support the foamed layer, and containing substantially no bubble. The substrate layer may be a skin layer which arises from a foaming resin in consequence of the foaming thereof. In this case, the substrate layer and the foamed lyer are made of one same resinous materials. Alternatively, the substrate layer may be in the form of a non-woven fabric.

Then, the plurality of bubbles in the foamed layer of the elastic foamed layer of this invention are formed so as to meet the following conditions (1) to (3).

To be specific, the bubbles in the elastic foamed sheet of this invention are (1) discrete bubbles dispersed at a substantially equal pitch in the direction of width of the foamed layer and are substantially equal in size and shape and in the position of formation relative to the direction of thickness. This statement indicates that the discrete bubbles which are uniform in cell size and cell shape are arranged at an equal pitch within the layer.

Figure 1:
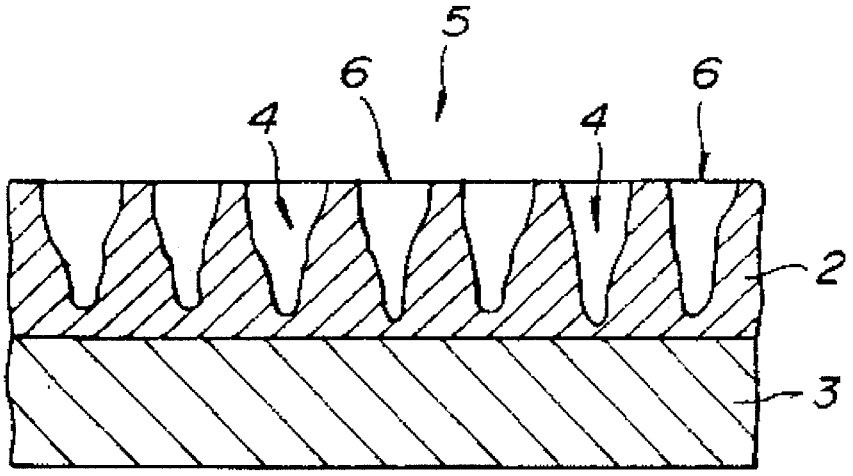
FIG. 1 is a schematic cross section illustrating part of an elastic foamed sheet as an embodiment of this invention.

Further, the bubbles are so formed that (2) the center lines in the direction of length thereof are parallel to the direction of thickness of the foamed layer. This statement indicates that the bubbles of the foamed sheet have a slender shape and the slender bubbles are erected parallelly to the direction of thickness of the foamed sheet as illustrated in FIG. 1.

(3) The diameters of the bubbles are minimized in the terminal parts of bubbles on the side of the boundary between the foamed layer and the substrate layer :and gradually increased in the direction from the boundary side to the surface side of the foamed layer and, at the same time, the bubbles form openings thereof in the surface of the foamed layer. This statement means that the bubbles are erected substantially perpendicularly to the substrate layer and the diameters of these bubbles decrease toward the lower parts of the bubbles (the substrate layer side) and increase gradually toward the upper parts of the bubbles (the surface of the foamed layer) as illustrated in FIG. 1.

Figure 6A:
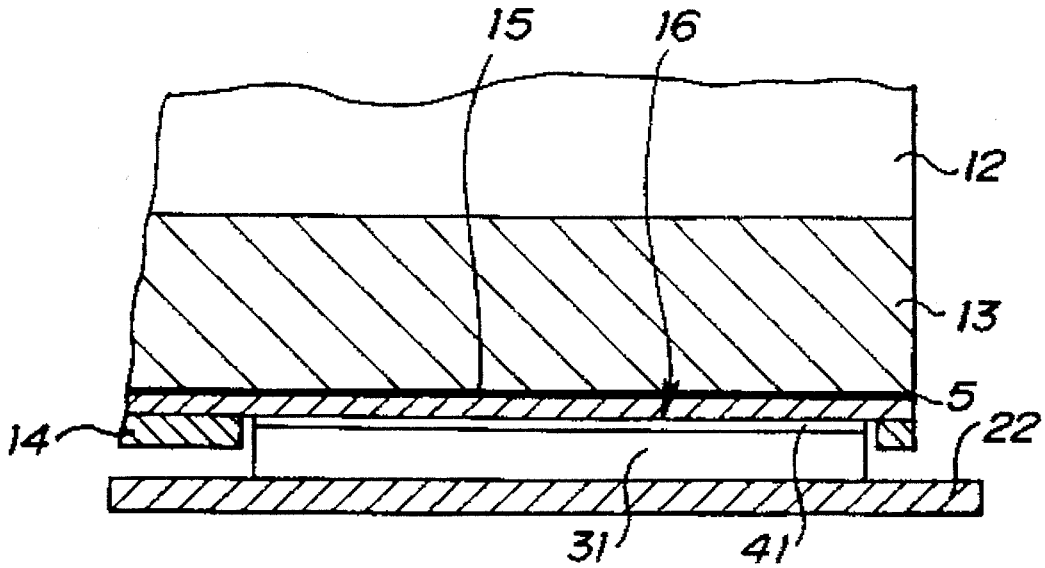
Figure 6B:
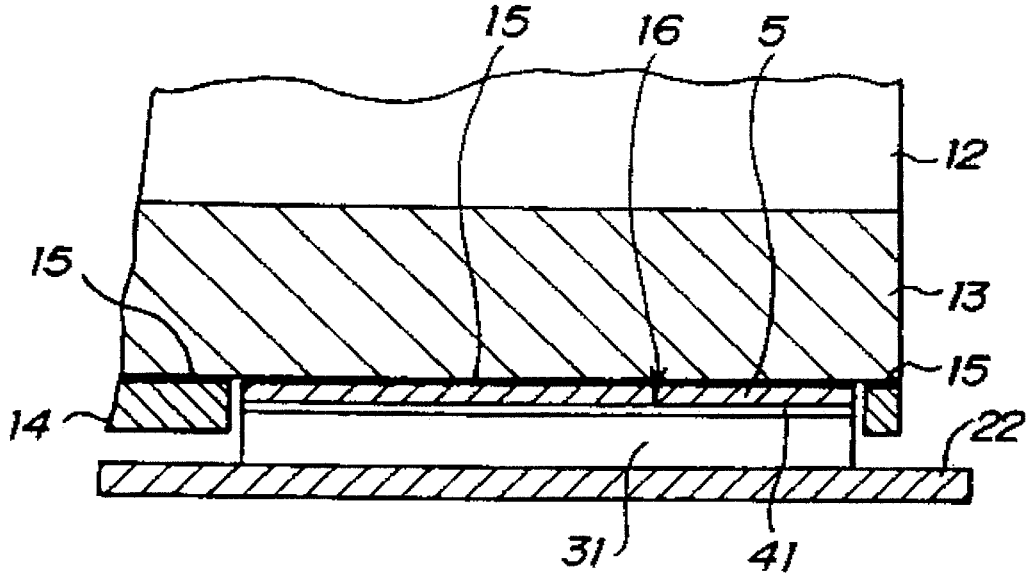

For the purpose of using the elastic foamed sheet of this invention as a backing pad, a wafer-polishing jig is formed by attaching the elastic foamed sheet on the substrate layer side thereof fast to carrier plates of a rotary attaching disc and attaching a template having a plurality of holes formed therein for positioning wafers fast to the surface of the elastic foamed sheet (the surface of the side in which the openings of bubbles are formed) as illustrated in FIG. 6*a* or by attaching the template having holes formed therein for positioning wafers to the carrier plates through the medium of an adhesive agent and attaching the discs of the elastic foamed sheet formed in shapes slightly smaller than those of the holes to the positions of the holes for positioning the wafers exclusively through the medium of an adhesive layer as illustrated in FIG. 6*b*. This wafer-polishing jig is used for the work of polishing wafers.

The wafer-polishing jig of this invention allows no interposition of any uncalled-for obstacle between the elastic foamed sheet and the carrier plates because the elastic foamed sheet is attached to the carrier plates exclusively through the medium of an adhesive layer. The degree with which the flatness of the carrier plates manufactured in high flatness is disturbed grows in proportion as the amount of interposed matter increases. In this invention, owing to the absence of interposed matter, the elastic foamed sheet enjoys high flatness and, therefore, the wafers to be polished by means of the jig of this invention acquire outstanding flatness.

When the wafer-polishing jig illustrated in FIG. 6*a* or FIG. 6*b* is used for the purpose of giving a mirror finish to wafers, backing pads impregnated with water are fitted in holes 16 of a template 14 and the wafers are pressed against the wet backing pads to expel the water from the backing pads and induce fast attachment of the wafers through aspiration to the backing pads. Thus, the wafers are ready for the polishing.

The wafers assume a hydrophilic rear surface when they have their rear surfaces coated with an oxide film ($SiO_2$ film). The wafers which have this oxide coating enjoy the advantage that the wafers are rotated on its axis more smoothly and, at the same time, the rear surfaces of the wafers are protected in the process of polishing.

The present inventors have found that when the elastic foamed sheet of this invention is used as a backing pad as described above, the wafers of a mirror finish obtained with a polishing device Using such backing pads enjoy outstanding flatness. One reason for this notable improvement in flatness is considered to reside in the fact that wafers are rotated and polished simultaneously. As respects the positional relation between the wafers to be polished and the carrier plates, when the wafers are perfectly fixed with the rear surfaces thereof, the wafers to be produced in a mirror finish acquire only a poor flatness because the portions of the rear surfaces of these wafers to be polished with a stationary disc are distributed unevenly. When the wafers are allowed to rotate in the process of polishing, however, the flatness of the polished surfaces is notably improved because the surfaces of the wafers being polished are evenly abraded by the stationary disc.

The backing pads contemplated by this invention possess suitable softness because the bubbles in the foamed layer are uniformly distributed as described above, the lateral walls of the bubbles on the surface side are sufficiently thin owing to the large void ratio of the surface of the foamed layer, and the increasing ratio of the wall thickness along the direction of thickness of the foamed layer in the periphery of each bubble is substantially uniform (the wall thickness gradually increasing in the direction from the openings' side to the substrate layer side). The surfaces of the backing pads kept in contact with the rear surfaces of the wafers in the process of polishing are parallel to the surfaces of the backing pads kept in the free state thereof. Thus, the wafers in the process of polishing are allowed to remain parallel to the surfaces of the carrier plates.

The elastic foamed sheet of this invention is produced by foaming an elastic macromolecular material. The elastic macromolecular materials which are effectively usable herein include polyurethane resin and such rubbery elastomers as styrene-butadiene copolymer, for example.

As one example of the way of producing the elastic foamed sheet of this invention, the method which comprises applying or casting a foaming resin such as, for example, a polyether type polyurethane to or on a film, foaming the applied or cast layer of the foaming resin, and then mechanically treating at least one of the opposite surfaces of the foamed resin layer thereby removing part of the thickness thereof may be cited. The mechanical treatment for the removal of part of the thickness is effected by grinding or cutting, for example. As a way of accurately producing a plane by grinding, the method which effects the surface grinding with a Surface grinder provided with a cup wheel having incorporated in the surface thereof which is produced by cementing hard abrasive particles such as diamond dust of an average particle diameter of from 50 to 100 μm as with a sintered metal may be cited, for example. In the grinding of this nature, the elastic foamed sheet is used as backing pads for polishing wafers. As a way of cutting the thickness with a cutter, the method which adopts a laser cutter may be cited, for example.

Now, the elastic foamed sheet as a preferred embodiment of this invention will be described below. The openings of bubbles in the elastic foamed sheet of this invention are desired to have a diameter of from 40 to 200 μm. If this diameter is less than 40 μm, the elastic foamed sheet's power to aspire wafers tends to be increased to the extent of obstructing the rotation of wafers contemplated by this invention. If the diameter exceeds 200 μm, the proportion of walls enclosing the bubbles therein decreases to the extent of impairing the sufficiency of the cushioning property the elastic foamed sheet is required to offer as backing pads. When the diameter is in the range of from 40 to 200 μm, the backing pads do not allow stagnation of air on the surface thereof and permits impartation of excellent flatness to a polished surface.

In this invention, the dimension of thickness constitutes itself an important factor. The overall thickness of the elastic foamed sheet is desired to exceed 20 μm and do not to exceed 250 μm. In the case of the elastic foamed sheet which comprises a substrate layer and a foamed layer, it is desirable that the substrate layer should be given a thickness of 10 μm or more and the thickness of the foamed layer should be selected in the range of from 20 to 240 μm. In the case of the elastic foamed sheet which consists solely of a foamed layer, it is desirable that the thickness of the sheet should be in the range of from 20 to 250 μm. Owing to this small thickness of foamed layer, the flatness of the carrier plates is directly passed to the wafers to be laid on the carrier plates and polished. So long as the backing pads possess a cushioning property above the allowable minimum, it is desirable from the viewpoint of flatness that any matter interposed between the backing pads and the wafers should possess the smallest possible thickness. In order for the elastic foamed sheet to avoid thinning to the extent of being affected adversely by the dust possibly intervening between the backing pads and the carrier plates even during the maximum compression deformation, it must possess a thickness which falls in the range mentioned above.

The surface void ratio of the foamed layer is desired to be in the range of from 90 to 98%. When the elastic foamed sheet of this invention is used as backing pads, since the area to be occupied by the bubbles in the surface of the backing pads (surface void ratio) is large and the wall thickness Of the elastic (macromolecular) material part (the wall part intervening between the bubbles) is small, the total area of the contact to be produced between the wafers and the backing pads when a load is exerted on the wafers during the work of polishing is small and the areas of the parts of contact between the backing pads and the wafers are not increased appreciably when the parts of contact are deformed by compression. The frictional resistance to be generated in these parts of contact, therefore, is small enough for the wafers to be simultaneously rotated and polished.

When the rear surfaces of the wafers to be polished have hydrophilicity, the rotation of the wafers mentioned above freely proceeds without incurring any resistance because a thin water film is formed between the rear surfaces of the wafers and the backing pads and this thin water film extremely lowers the friction coefficient of the parts of contact between the rear surfaces of wafers and the backing pads.

The difference, $D_1$–$D_2$, is desired to be from 50 to 100 μm, providing that $D_1$ stands for the thickness of the foamed layer which is assumed after 10 seconds' exertion of a load of 300 gf/cm$^2$ and $D_2$ for the thickness assumed after 10 seconds' exertion of a load of 1,800 gf/cm$^2$ respectively on the wafer-retaining surface thereof. This difference, $D_1$–$D_2$, represents the softness of the foamed layer which is in reverse proportion to the elastic modulus after compression of the foamed layer.

The recovery ratio of the foamed layer which is defined by the formula 1 mentioned above is desired to be from 50 to 80%. This recovery ratio denotes the degree with which the state assumed by the foamed layer after exertion thereon of a large compressive stress returns to the state assumed after the removal of the compressive stress. The statement that the recovery ratio is from 50 to 80% means that the foamed layer requires itself to absorb the large stress by generating a permanent strain and that this requirement is ideally accomplished when the recovery ratio falls on this order.

The compression ratio of the foamed layer which is defined by the formula 2 mentioned above is desired to be from 30 to 50%. The compression ratio of this definition presumes the load which is fated to be exerted on the backing pads while the wafers are being polished. When the compression ratio is so high as to fall in the range of from 30 to 50%, the Mount of deformation of the elastic material forming the bubble walls varies proportionately to the variation of the load exerted wafers even if this load is uneven. Thus, the wafers are eventually retained at fixed positions relative to the carrier plates.

Now, this invention will be described more specifically below with reference to working examples.

Example 1:

(1) Production of foamed sheet

Figure 3:
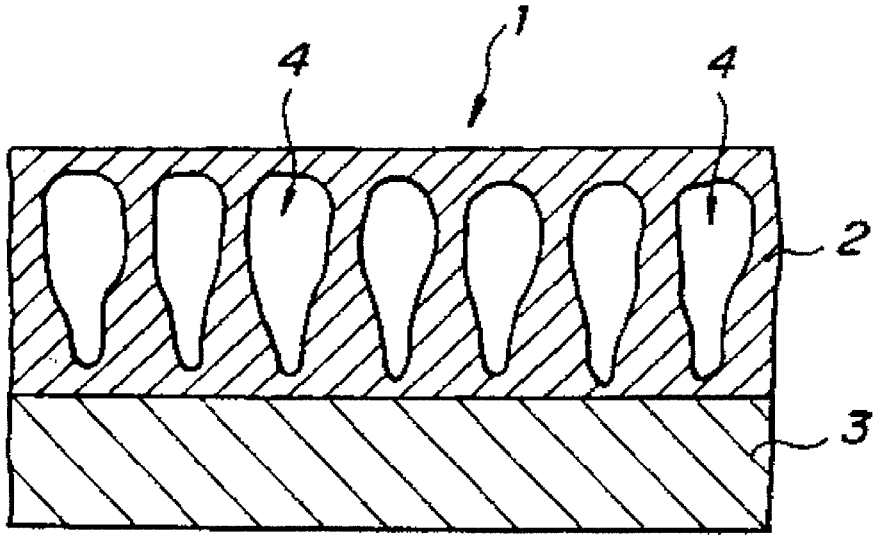
FIG. 3 is a schematic cross section illustrating part of a laminate incorporated in the embodiment of FIG. 1 as prepared for polishing with a planar grinder.

A foaming resinous composition of polyester type polyurethane was applied to a substrate layer of a biaxially stretched polyester film of a thickness of 40 μm. By thermally foaming the superposed layers at 60° C., a laminate 1 shaped as illustrated in FIG. 3 was obtained. In the diagram, 2 stands for a foamed layer of polyurethane, 3 for a substrate layer, and 4 for a bubble. The foamed layer 2 had a thickness of 380 μm.

Figure 2:
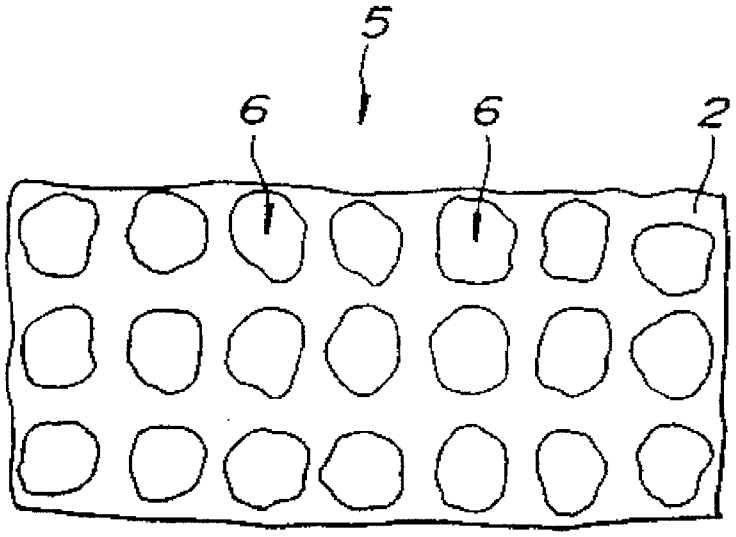
FIG. 2 is a plan view illustrating the elastic foamed sheet of the embodiment of FIG. 1.

This laminate was ground with a surface grinder to decrease the thickness of the foamed layer to 150 μm and then cut to a prescribed size to obtain an elastic foamed sheet 5 of this invention illustrated in FIG. 1 and FIG. 2. In this elastic foamed sheet, the plurality of bubbles in the foamed layer were slender discrete bubbles parallelly dispersed at an equal pitch in the direction of width of the foamed layer. These bubbles are substantially equal in size, shape, and position of formation in the direction of thickness of the foamed layer. The center lines of these bubbles in the direction of length thereof are parallel to the direction of thickness of the foamed layer. The diameters of the bubbles are minimized in the terminal parts of bubbles on one surface side of the foamed layer and gradually increased in the direction from this one surface side to the other surface side of the foamed layer. At the same time, the bubbles form openings 6 of their own in the surface of the foamed layer. The elastic foamed sheet 5 has such a cross-sectional structure as illustrated in FIG. 1. The surface pore diameter, namely the diameter of the openings 6 equivalent to the upper terminal parts of the bubbles 4, is about 100 μm. The surface void ratio is about 92%.

(2) Mechanical properties of foamed layer 2 of elastic foamed sheet

The foamed layer 2 mentioned above was tested for such mechanical properties as softness, recovery ratio, and compression ratio. In the test, three loads, 300 gf/cm$^2$×10 seconds as $W_1$, 1,800 gf/cm$^2$×10 seconds as $W_3$, and 300 gf/cm$^2$×10 seconds as $W_3$, were exerted sequentially in the order mentioned on the surface of the foamed layer 2 (the surface on the side in which the openings 6 are formed) and the thickness, $D_1$, $D_2$, and $D_3$ which the foamed layer 2 assumed respectively under the loads mentioned above. The softness was calculated from the difference, $D_1$–$D_2$, the recovery ratio from the formula 1 mentioned above, and the compression ratio from the formula 2 mentioned above.

As a result, $D_1$ was found to be 159 μm, $D_2$ to be 94 μm, $D_3$ to be 139 μm, the softness to be 65 μm, the recovery ratio to be 69%, and the compression ratio to be 41%.

(3) Trial polishing of wafer

Figure 5:
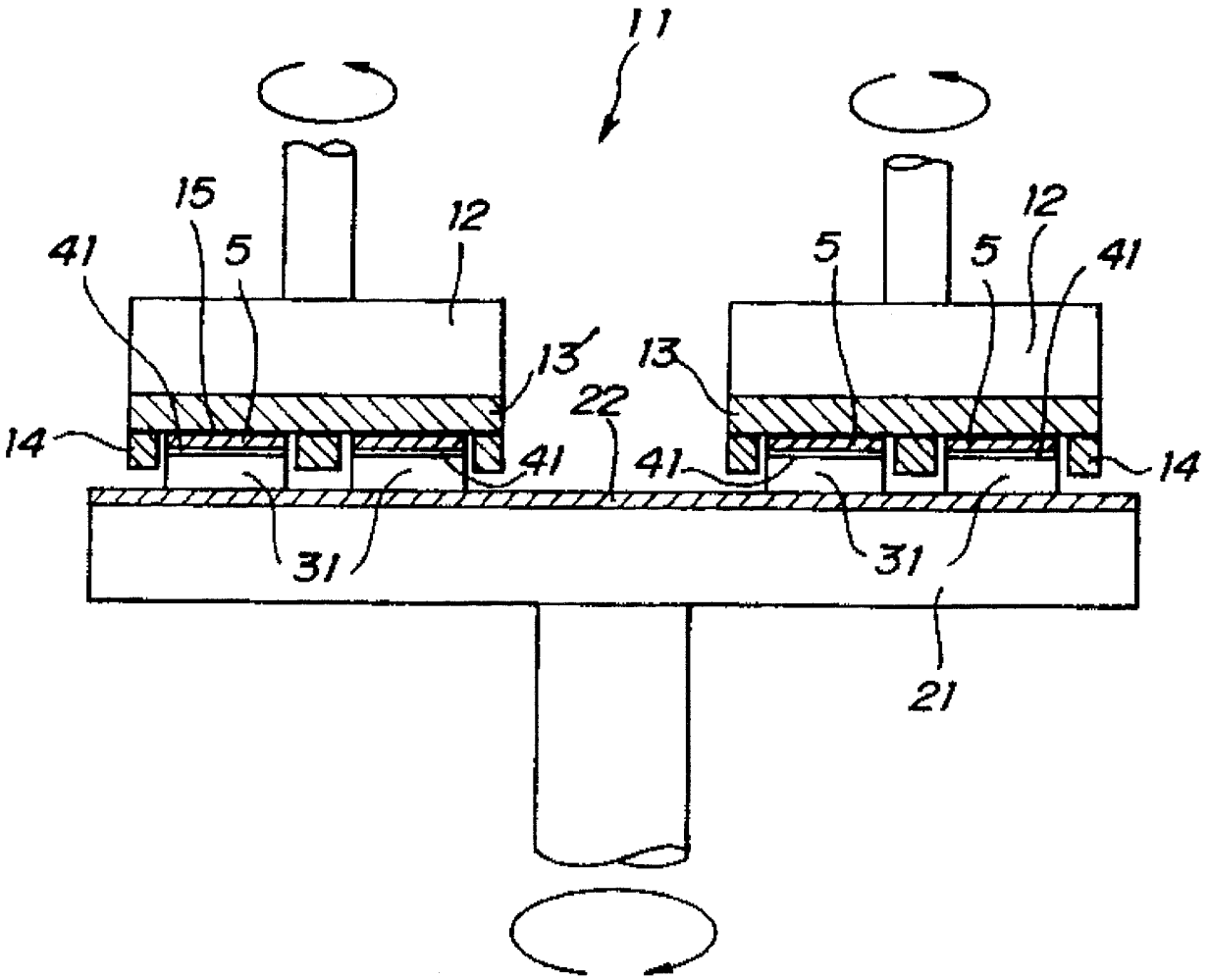
FIG. 5 is a schematic cross section illustrating the essential part of a grinder for giving a mirror polish to a silicon wafer.

Foamed sheets 5 obtained as described above were set in a polishing device 11 as illustrated in FIG. 5 and used to polish silicon wafer 31 having $SiO_2$ film deposited on the rear surfaces thereof. The polished surfaces of the wafers were tested for flatness TTV.

In FIG. 5, 12 stands for a rotary attaching disc, 13 for a carrier plate, 14 for a template, 21 for a rotary disc, and 22 for an abrasive cloth.

In preparation for the polishing, the template 14 was attached to the surface side of the elastic foamed sheets 5, the elastic foamed sheets 5 were attached fast on the substrate side thereof to the carrier plates 13 through the medium of adhesive agent, and then silicon wafers 31 wetted on one side thereof with water were pressed into fast contact with the surface side of the elastic molded sheets 5 and consequently set in place. The retention of the silicon wafers 31 originated in the force of aspiration due to the state of a vacuum produced in consequence of the expulsion of water through the voids of the foamed sheet. Then, the abrasive cloth 22 was supplied with an abrasive liquid and the rotary attaching disc 12 was lowered and pressed against the abrasive cloth 22. The friction force generated by the rotation of the rotary attaching disc 12 and the rotary disc 21 was utilized for polishing the silicon wafers 31.

When 1,270 silicon wafers were polished with the polishing device 11 operated as described above, the polished wafers were found to possess an average TTV value of 1.02 μm and a standard deviation of 0.27 μm, indicating that they possessed high flatness deserving the designation of mirror finish.

Example 2

Elastic foamed sheets similarly shaped as illustrated in FIG. 1 were produced by superposing a foamed layer of polyurethane on the same substrate layer of polyester film by following the procedure of Example 1.

In this case, the elastic foamed sheets were allowed to vary such properties of the foamed layer as thickness and surface pore diameter by varying the components in the foaming resinous composition of polyurethane, the heating temperature and temperature increasing rate in the process of foaming, the thickness of the foaming composition applied, and the thickness of the foamed layer removed by grinding with the surface grinder. These elastic foamed sheets were used for trial polishing of silicon wafers by following the procedure of Example 1.

The properties of the foamed layer and the flatness of the polished wafers are shown in Table 1.

and a compression ratio of 30 to 50% permits production of a polished wafer of mirror finish enjoying high flatness and suffering from uneven polishing only sparingly.

Example 3

A laminate 1 shaped as illustrated in FIG. 3 was produced by applying a foaming resinous composition of a polyether type polyurethane to a biaxially stretched polyester film of a thickness of 60 μm and thermally foaming the resultant superposed layers at 60° C. The foamed layer of this laminate 1 had a thickness of 400 μm.

Figure 4:
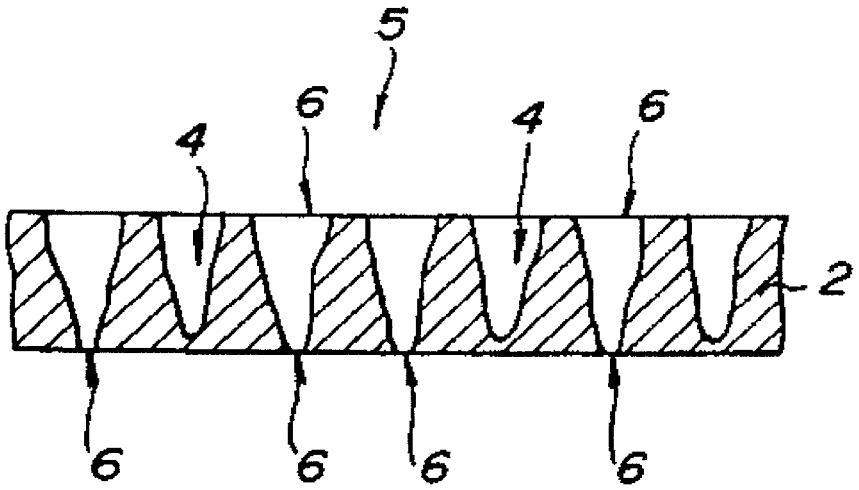
FIG. 4 is a schematic cross section illustrating part of an elastic foamed sheet as another embodiment of this invention.

This laminate was separated into the biaxially stretched polyester film and the foamed layer of polyurethane by peeling. Then, the foamed sheet was ground with a surface grinder until a thickness of 220 μm. Then by cutting the thinned foamed sheet in a prescribed size to obtain elastic foamed sheets of this invention shaped as illustrated in FIG. 4. These elastic foamed sheets were foamed solely of a foamed layer and were devoid of a substrate layer. The side of each elastic foamed sheet on which the areas of openings were larger corresponded to the surface from which the film had been peeled and, therefore, the surface formed by grinding with the surface grinder. The side on which the areas of openings were smaller corresponded to the side of free foaming of the foamed sheet. The openings of smaller areas had been formed by rupture of the surface cell wall in the process of foaming.

The surface pore diameter was about 98 μm and the surface void ratio was 93% on the side of the foamed sheet having the larger areas of openings.

When the foamed sheet was tested for mechanical properties, $D_1$ was found to be 160 μm, $D_2$ to be 95 μm, $D_3$ to be 140 μm, the softness to be 65 μm, the recovery ratio to be 70%, and the compression ratio to be 41%.

The foamed sheets were used as backing pads for trial polishing of wafers. The polished wafers were found to possess an average TTV value of 1.01 μm and a standard deviation of 0.26 μm, Indicating that they possessed high flatness deserving the designation of mirror finish.

Comparative Experiment 1

A foamed layer of polyurethane resin was formed on a polyester film in the same manner as in Example 1. The

TABLE 1

| | Foamed layer Properties of packing pad | | | | | | | | | |
|---|---|---|---|---|---|---|---|---|---|---|
| | Total | Surface pore | Surface | | | | Number of | TTV (μm) | | |
| Sample No. | thickness (μm) | diameter (μm) | void ratio (%) | Softness (μm) | Recovery ratio (%) | Compression ratio (%) | wafers polished | Average | Standard deviation | Rating |
| 1 | 160 | 50 | 91 | 80 | 65 | 40 | 1000 | 0.98 | 0.21 | Good |
| 2 | 250 | 40 | 90 | 70 | 60 | 30 | 1000 | 1.00 | 0.24 | Good |
| 3 | 200 | 200 | 98 | 100 | 80 | 50 | 1000 | 0.90 | 0.20 | Good |
| 4 | 120 | 150 | 97 | 50 | 70 | 40 | 1000 | 0.86 | 0.27 | Good |
| 5 | 180 | 100 | 95 | 90 | 50 | 35 | 1000 | 1.01 | 0.25 | Good |

In the elastic foamed sheets indicated as Samples Nos. 1 to 5 in Table 1, the foamed layers fulfilled the numerical ranges defined in the aforementioned third aspect of this invention. The data of the table indicate that an elastic foamed sheet provided with a foamed layer possessing such properties as a thickness of 250 μm or less, a surface pore diameter of 40 to 200 m, a surface void ratio of 90 to 98%, a softness of 50 to 100 μm, a recovery ratio of 50 to 80%, resultant superposed layers were ground with a surface grinder to produce a foamed sheet 390 μm in thickness. This foamed sheet was attached fast to a substrate of biaxially stretched film 100 μm in thickness to produce an elastic foamed sheet. This elastic foamed sheet was used to polish 9,600 silicon wafers in the same manner as in Example 1.

The polished silicon wafers were found to possess an average TTV value of 1.47 μm and a standard deviation of 0.41 μm.

Similar elastic foamed sheets were produced, excepting the thickness of the foamed sheet was varied in the range of from 125 to 500 μm and the thickness of the substrate was varied in the range of from 125 to 200 μm. These elastic foamed sheets were used as backing pads for polishing silicon wafers. The polished silicon wafers were found to have average TTV values of from 1.41 to 1.63 μm and standard deviations of from 0.42 to 0.56 μm.

Comparative Experiment 2

In accordance with the conventional wax process, 5,900 silicon wafers were polished by the use of the same polishing device as used in Example 1. In this case, the application of wax was carried out by the spin coating method.

The polished silicon wafers were found to possess an average TTV value of 1.25 μm and a standard deviation of 0.45 μm.

As clearly noted from the description given thus far, when the elastic foamed sheet conforming to the definition given in claim 1 is used as a backing pad for polishing wafers, the wafers polished to a mirror finish excel both in surface roughness and flatness because the wafers are polished as held parallelly to the carrier plates and the-frictional force produced by the backing pads to the wafers is small enough for the wafers to be simultaneously rotated and polished.

The elastic foamed sheet conforming to the definition given in the aforementioned second aspect of this invention enjoys high strength as a whole because the foamed layer is reinforced with the substrate layer.

The elastic foamed sheet conforming to the definition given in the aforementioned third aspect of this invention and the elastic foamed sheet of which the total thickness of said substrate layer and said foamed layer is 250 μm at most have a thickness small enough to avoid yielding to the adverse effects of a displacement of its own but not small enough to yield to the adverse effects of dust suffered to intervene between the backing pads and the carrier plates. It has a pore diameter so large as to preclude entry of air into the interface between the backing pads and the wafers. Thus, the elastic foamed sheet brings about an effect of permitting production of wafers of mirror finish showing a TTV value of 0.8 to 1.0 μm, namely excellent flatness of a degree surpassing that of the flatness obtainable by the wax process.

The wafer-polishing jig conforming to the definition given In the aforementioned forth and fifth aspect of this invention have elastic foamed sheets attached fast to carrier plates exclusively through the medium of an adhesive layer and has no uncalled-for matter interposed between the elastic foamed sheets and the carrier plates. As a result, the elastic foamed sheets applied fast to the carrier plates enjoy satisfactory flatness benefitting from the absence of such intervening matter. Thus, the wafer-polishing jig allows production of polished wafers which have ideal flatness.

Particularly, the wafer-polishing jig conforming to the definition given in the aforementioned fifth aspect of this invention permits impartation of still better flatness to the polished wafers because the elastic foamed sheets are foamed of a separate material from the template and, as a consequence, the pressure exerted on the wafers in the process of polishing is uniformly distributed throughout the entire surfaces of the wafers.

What is claimed is:

1. A wafer polishing jig having a backing pad for retaining a semiconductor wafer during polishing, said backing pad possessing at least a foamed layer, characterized by the fact that a plurality of bubbles in said foamed layer meet the following conditions:

(1) that said bubbles are slender discrete bubbles erected parallel to one another and dispersed at a substantially equal pitch in the direction of width of said foamed layer and said bubbles are substantially equal in size, shape, and position of formation in the direction of thickness of said foamed layer, (2) that the center lines of said bubbles in the direction of length thereof are parallel to the direction of thickness of said foamed layer, (3) that the diameters of said bubbles are minimized in the terminal part of the foamed layer on one surface side thereof and gradually increase in the direction from said one surface side to the other surface side of said foamed layer until said bubbles form openings thereof in the surface of said foamed layer, (4) that the diameters of said openings of bubbles are from 40 to 200 μm, (5) that the thickness of said foamed layer exceeds 20 μm and does not exceed 250 μm, (6) that the surface void ratio of said foamed layer (total sum of the areas of said openings of bubbles divided by the area of the wafer-supporting surface of said foamed layer (inclusive of the areas of openings of bubbles) and multiplied by 100) is from 90 to 98%, (7) that the softness of said foamed layer (difference, $D_1-D_2$, wherein $D_1$ stands for the thickness of said foamed layer assumed under a load of 300 gf/cm$^2$×10 seconds and $D_2$ for the thickness of said foamed layer assumed under a load of 1,800 gf/cm$^2$×10 seconds respectively exerted on the wafer-retaining surface of said foamed layer) is from 50 to 100 μm, (8) that the recovery ratio of said foamed layer defined by the following formula is from 50 to 80%:

$$\text{Recovery Ratio}=(D_3-D_2)/(D_1-D_2)\times 100(\%)$$

(wherein $D_1$ and $D_2$ have the same meanings as defined above and $D_3$ stands for the thickness of said foamed layer assumed under a load of 300 gf/cm$^2$×10 seconds exerted on the wafer-supporting surface of said foamed layer subsequently to the sequential exertion of a load of 300 gf/cm$^2$×10 seconds and a load of 1,800 gf/cm$^2$× 10 seconds in the order mentioned), and (9) that the compression ratio of said foamed layer defined by the following formula is from 30 to 50%:

$$\text{Compression Ratio}=(D_1-D_2)/D_1\times 100(\%)$$

(wherein $D_1$ and $D_2$ have the same meanings as defined above), wherein said backing pad is attached exclusively through the medium of an adhesive layer to the entire upper surface of a carrier plate and a template furnished with holes for positioning wafers for mirror polishing is attached through the medium of an adhesive layer to the upper surface of said elastic foamed sheet.

2. A wafer polishing jig having a backing pad in accordance with claim 1, wherein said backing pad comprises said foamed layer of a large thickness and a substrate layer integrally adjoining said foamed layer, serving to support said foamed layer, and containing virtually no bubble.

3. A wafer polishing jig having a backing pad in accordance with claim 2, wherein the total thickness of said substrate layer and said foamed layer is 250 μm at most.

4. A wafer polishing jig having a backing pad in accordance with claim 2, wherein said substrate layer is made of the same resinous material as said foamed layer.

5. A wafer polishing jig having a backing pad in accordance with claim 2, wherein said substrate layer is made of a plastic film or a non-woven fabric.

6. A wafer polishing jig having a backing pad in accordance with claim 11, wherein said foamed layer is made of a bubble-containing polyurethane resin produced by foaming a polyurethane resin on a heat-resistant macromolecular film supporting member.

7. A wafer polishing jig having a backing pad in accordance with claim 2, wherein said foamed layer is made of a bubble-containing polyurethane resin produced by foaming a polyurethane resin on a heat-resistant macromolecular film supporting member.

8. A wafer polishing jig having a template furnished with holes for positioning wafers for mirror polishing attached to an upper surface of a carrier plate through a medium of an adhesive agent and discs of an elastic foamed layer formed in shapes slightly smaller than that of said holes attached to the carrier plate in the holes through medium of an adhesive layer, said foamed layer characterized by the fact that a plurality of bubbles in said foamed layer meet the following conditions:

(1) that said bubbles are slender discrete bubbles erected parallel to one another and dispersed at substantially equal pitch in the direction of width of said foamed layer and said bubbles are substantially equal in size, shape, and position of formation in the direction of thickness of the foamed layer, (2) that the center lines of said bubbles in the direction of length thereof are parallel to the direction of thickness of said foamed layer, (3) that the diameters of said bubbles are minimized in the terminal part of the foamed layer on one surface side thereof and gradually increase in the direction from said one surface side to the other surface side of said foamed layer until said bubbles form openings thereof in the surface of said foamed layer, (4) that the diameters of said openings of bubbles are from 40 to 200 μm, (5) that the thickness of said foamed layer exceeds 20 μm and does not exceed 250 μm, (6) that the surface void ratio of said foamed layer (total sum of the areas of said openings of bubbles divided by the area of the wafer-supporting surface of said foamed layer (inclusive of the areas of openings of bubbles) and multiplied by 100) is from 90 to 98%, (7) that the softness of said foamed layer (difference $D_1-D_2$, wherein $D_1$ stands for the thickness of said foamed layer assumed under a load of 300 gf/cm$^2$×10 seconds and $D_2$ for the thickness of said foamed layer assumed under a load of 1,800 gf/cm$^2$×10 seconds respectively exerted on the water-retaining surface of said foamed layer) is from 50 to 100 μm, (8) that the recovery ratio of said foamed layer defined by the following formula is from 50 to 80%:

$$\text{Recovery Ratio}=(D_3-D_2)/(D_1-D_2)\times 100(\%)$$

(wherein $D_1$ and $D_2$ have the same meanings as defined above and $D_3$ stands for the thickness of the foamed layer assumed under a load of 300 gf/cm$^2$×10 seconds exerted on the wafer-supporting surface of said foamed layer subsequently to the sequential exertion of a load of 300 gf/cm$^2$×10 seconds and a load of 1,800 gf/cm$^2$× 10 seconds in the order mentioned, and (9) that the compression ratio of said foamed layer defined by the following formula is from 30 to 50%:

$$\text{Compression Ratio}=(D_1-D_2)/D_1\times 100(\%)$$

(wherein $D_1$ and $D_2$ have the same meanings as defined above).

9. A wafer polishing jig in accordance with claim 8, wherein said foamed layer comprises a large thickness and a substrate supporting layer integrally adjoining said foamed layer which contains virtually no bubbles.

10. A wafer polishing jig in accordance with claim 9, wherein the total thickness of said substrate supporting layer and said foamed layer is 250 μm at most.

11. A wafer polishing jig in accordance with claim 9, wherein said substrate supporting layer is made of the same resinous material as said foamed layer.

12. A wafer polishing jig in accordance with claim 9, wherein said substrate supporting layer is made of a plastic film or a nonwoven fabric.

13. A wafer polishing jig in accordance with claim 9, wherein said foamed layer is made of a bubble-containing polyurethane resin produced by foaming a polyurethane resin on a heat-resistant macromolecular film supporting member.

14. A wafer polishing jig in accordance with claim 8, wherein said foamed layer is made of a bubble-containing polyurethane resin produced by foaming a polyurethane resin on a heat-resistant macromolecular film supporting member.

15. The wafer polishing jig having a backing plate in accordance with claim 1 further comprising a template furnished with holes for positioning wafers for polishing, said template being attached by an adhesive to an upper surface of said elastic foamed layer.

16. A wafer polishing jig having a backing pad in accordance with claim 1 wherein said backing pad is attached to an upper surface of a carrier plate by an adhesive.

17. A wafer polishing jig having a backing pad in accordance with claim 15, wherein said backing pad is attached to an upper surface of a carrier plate by an adhesive.

* * * * *